US006762660B2

(12) United States Patent
Allison

(10) Patent No.: US 6,762,660 B2
(45) Date of Patent: Jul. 13, 2004

(54) COMPACT EDGE COUPLED FILTER

(75) Inventor: Robert C. Allison, Rancho Palos Verdes, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/157,355

(22) Filed: May 29, 2002

(65) Prior Publication Data

US 2003/0222736 A1 Dec. 4, 2003

(51) Int. Cl.[7] ..... H01P 1/20; H01P 1/203
(52) U.S. Cl. ..... 333/204; 333/161; 333/202
(58) Field of Search ..... 333/99 S, 202, 333/204, 205, 161

(56) References Cited

U.S. PATENT DOCUMENTS 4,020,428 A 4/1977 Friend
4,560,964 A 12/1985 Meier
4,701,727 A 10/1987 Wong
5,015,976 A 5/1991 Saka
5,404,119 A 4/1995 Kim
5,616,538 A * 4/1997 Hey-Shipton et al. ..... 505/210
5,770,546 A * 6/1998 Grothe et al. ..... 505/210
5,949,311 A * 9/1999 Weiss et al. ..... 333/202
6,094,588 A * 7/2000 Adam ..... 505/210

OTHER PUBLICATIONS

"Microwave Filters, Impedance–Matching Networks, and Coupling Structures," by George L. Matthael et al, Artech House, 1980, Section 8.09, pp. 472–477.

* cited by examiner

*Primary Examiner*—Robert Pascal
*Assistant Examiner*—Dean Takaoka
(74) *Attorney, Agent, or Firm*—Leonard A. Alkov

(57) ABSTRACT

A band pass filter circuit for microwave frequencies, including a plurality of parallel-coupled resonators formed in a planar transmission line medium, including coupling between alternate resonators in the form of transmission line gaps.

15 Claims, 2 Drawing Sheets

COMPACT EDGE COUPLED FILTER

BACKGROUND OF THE DISCLOSURE

Filters with parallel-coupled resonators in microstrip or strip-line are known in the art, e.g., *Microwave Filters, Impedance-Matching Networks, and Coupling Structures*, George I. Matthaei et al., Artech House, 1980, at Section 8.09, pages 472-477. An exemplary parallel-coupled resonator filter 10 is shown in FIG. 1. The filter includes a dielectric substrate having opposed planar surfaces, with a ground plane layer on a bottom surface, and input/output (I/O) ports 14, 16. A conductor strip 14A is formed on the upper surface of the substrate to connect to the I/O port 14. A conductor strip 16A is formed on the upper surface of the substrate to connect to the I/O port 16. Microwave energy is coupled between the I/O ports by a series of conductive strips 18-1, 18-2 . . . 18-7 defining a series of spaced resonators on the upper surface. The resonators are staggered along a diagonal 20.

The parallel-coupled resonator filter is often placed in a channel in a conductive housing structure, in which unwanted waveguide modes can propagate due to the relatively large channel width needed to accommodate the width of the filter.

SUMMARY OF THE DISCLOSURE

A band pass filter circuit for microwave frequencies is described, comprising a plurality of parallel-coupled resonators formed in a planar transmission line medium, including coupling between alternate resonators in the form of transmission line gaps.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 2:
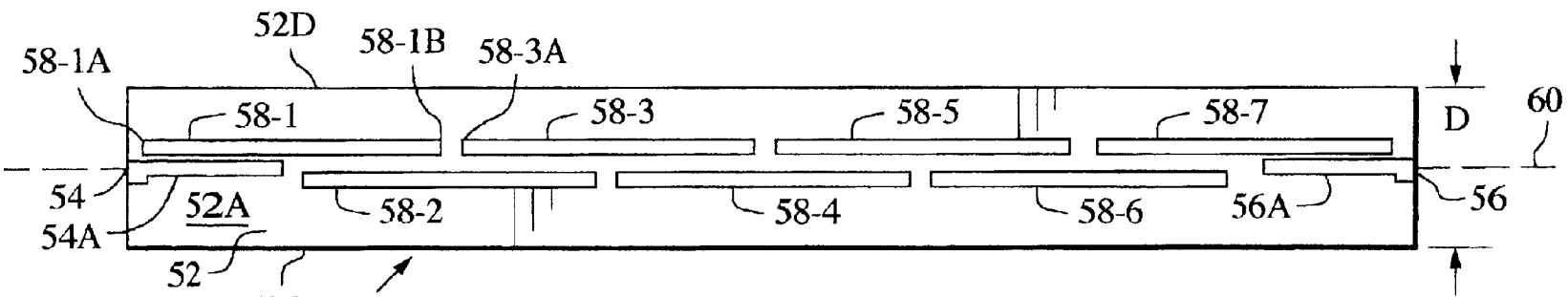
FIG. 2 is a diagrammatic top view of an embodiment of a filter circuit in accordance with the invention.
Figure 3:
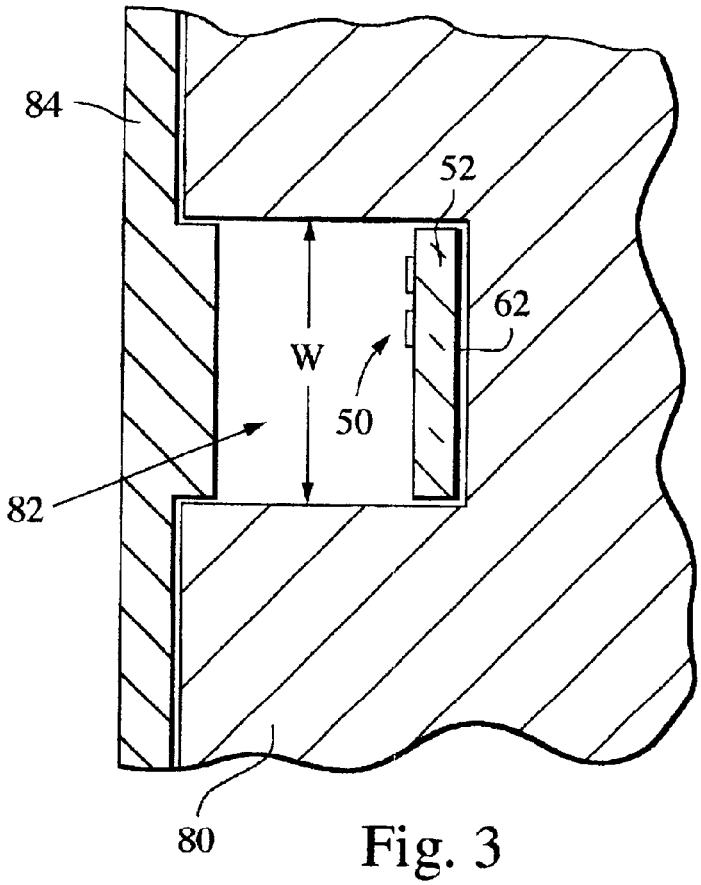
FIG. 3 is an end view illustration of the filter circuit of FIG. 2 in a housing structure.

An exemplary embodiment of a band pass filter circuit 50 in accordance with aspects of this invention is shown in FIGS. 2 and 3. The circuit 50 is a band pass filter circuit for use at microwave frequencies using a planar transmission line medium such as microstrip or stripline. The filter topology allows the filter 50 to be fabricated in a narrow geometry and improves performance.

The exemplary embodiment of FIG. 2 is implemented in microstrip transmission line. The filter 50 includes a dielectric substrate 52, e.g., alumina, having a lower surface and an upper surface 52A. The lower surface is covered with a conductive ground plane layer 62 (FIG. 3). The upper surface has a conductor pattern formed thereon, e.g. using photolithographic techniques. The pattern includes a conductor strip 54A connected to an I/O port 54, and a conductor strip 56A connected to an I/O port 56. As with the filter 10 of FIG. 1, microwave energy is coupled between the ports 54, 56 by a series of resonators. However, the topology is significantly different than that of the filter 10. The same elongate side of each resonator conductor strip faces the adjacent resonator conductor strips, in contrast to the circuit of FIG. 1, wherein both elongate sides face an adjacent resonator. Thus, in the filter circuit 50, the lower elongate sides of the resonators 58-1, 58-3, 58-5, 58-7 face the upper elongate sides of the resonators 58-2, 58-4, 58-6. In this embodiment, this allows the resonators to be placed in a staggered arrangement along an axis 60 which is generally parallel to the longitudinal sides 52C, 52D of the substrate 52.

The I/O ports 54, 56 can be connected to coaxial connectors, or connected to other circuitry by microstrip (or stripline) transmission lines, or other types of transmission lines, depending on the particular application.

Figure 1:
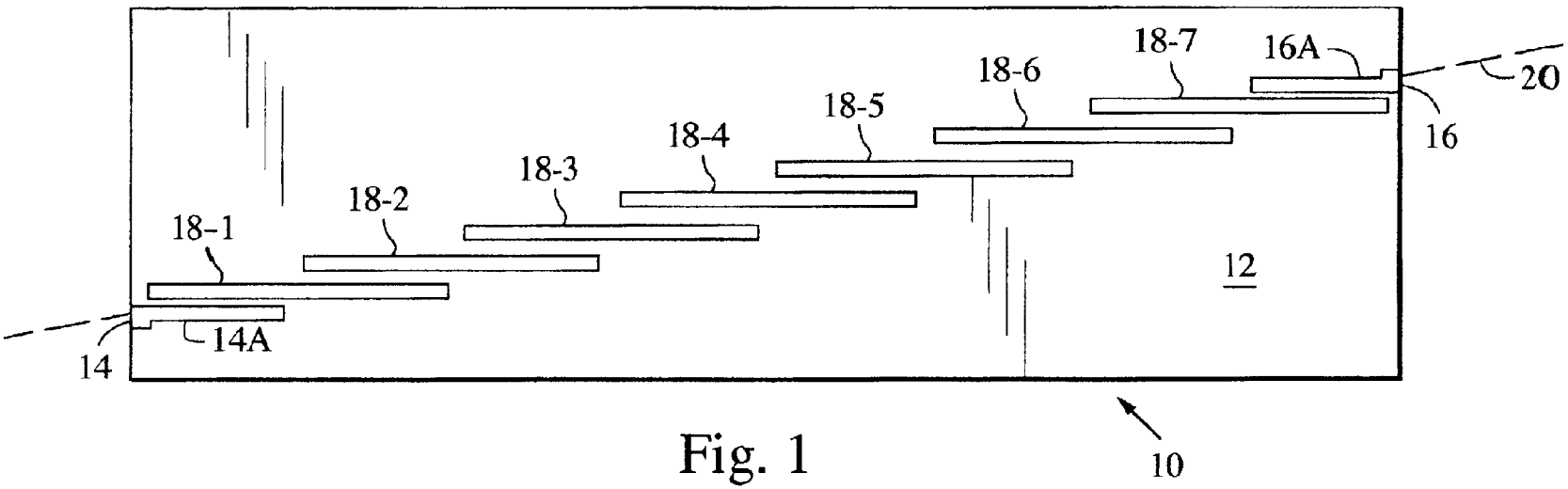
Fig. 1 (Prior Art)
FIG. 1 is a diagrammatic top view of a known type of a parallel-coupled resonator filter.

It can be seen that the filter circuit 50 of FIG. 2 is much narrower than the filter circuit 10 of FIG. 1, i.e. the dimension D (FIG. 2) is much smaller than the corresponding dimension for the filter circuit 10. In addition to the benefits of occupying less area, this filter topology will fit into a narrower channel with higher cutoff frequency. This results in improved filter rejection at higher frequencies compared to what could be achieved with the traditional approach. This is because the channel surrounding the filter circuit 50 will not support propagating waveguide modes to higher frequencies than a corresponding, wider channel surrounding the filter 10, preventing these modes from degrading filter rejection. Even if the conventional filter is oriented diagonally to minimize channel width, the new filter approach will always occupy a narrower channel. In an exemplary embodiment, the filter is approximately 60% of the conventional filter width.

FIG. 3 is a diagrammatic end view illustration of the filter circuit 50 disposed in a housing structure 80 defining a narrow channel 82, with a cover structure 84 disposed over the channel. Typically the channel is a conductive structure, e.g. fabricated of aluminum, and thus forms a waveguide-like structure in which waveguide modes can propagate. The minimum width W of the channel is determined by the width dimension D of the substrate. The width W can be made smaller with the circuit 50 than the circuit 10, thus raising the cutoff frequency below which waveguide modes of microwave energy will not propagate. For many applications, the waveguide mode cutoff frequency will be above the bandpass frequency range, i.e. the channel width is selected to place the cutoff frequency for waveguide modes above the bandpass. There may of course be applications for which waveguide mode propagation is not an important issue, and for such applications, the channel width may not be so narrow as to place the cutoff frequency above the bandpass frequency range.

The topology of the filter circuit 50 provides another feature, in addition to the reduced size. While it is believed that most of the microwave energy will propagate from resonator 58-1 to resonator 58-2 to resonator 58-3 to resonator 58-4 to resonator 58-5 to resonator 58-6 to resonator 58-7, some energy will also be propagated due to alternate resonator coupling. The alternate resonator coupling is due to the adjacent end edges of alternate resonators. Thus, for example, some energy will be coupled from resonators 58-1 and 58-3 due to their adjacent end edges 58-1B and 58-3A. The resonator spacing can be tuned to achieve shaping of the filter response. Software programs such as the Advanced Design System (ADS) marketed by Agilent Technologies can be used to model the circuit.

Figure 4:
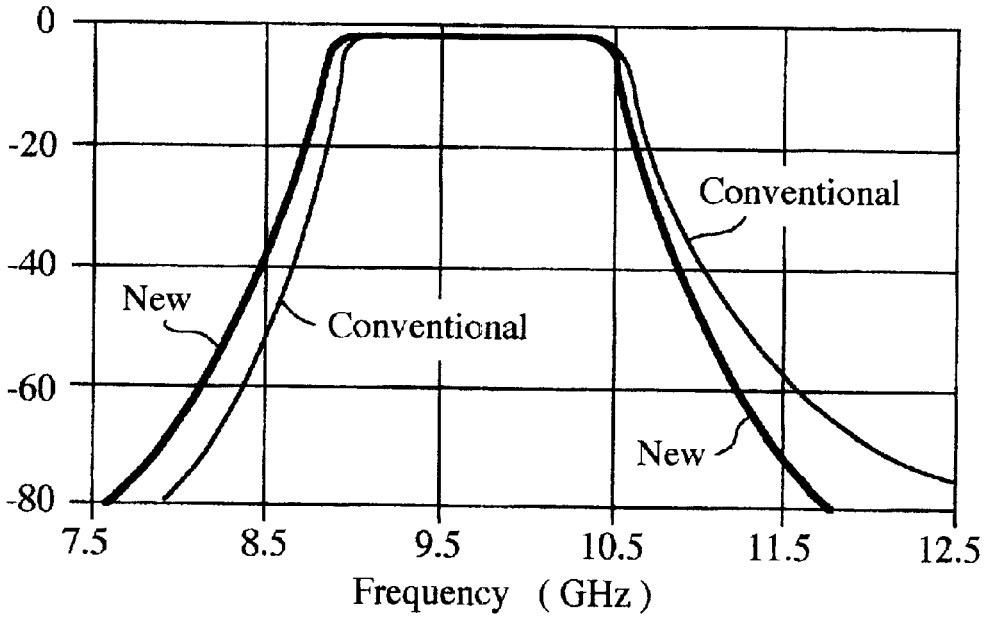
FIG. 4 is a graphical illustration of exemplary filter responses of a conventional filter and of an embodiment of a filter in accordance with the invention.

FIG. 4 shows exemplary filter responses of embodiments of the filters 10 and 50. The filter networks are identical except for alternate resonator coupling. The filter with no alternate resonator coupling represents the conventional coupled line filter response. It is always an asymmetrical response; i.e. the lower filter skirt is steeper than the upper skirt. With proper choice of resonator end gaps, the filter 50 response can be made generally symmetrical.

Advantages of exemplary embodiments of this filter topology include smaller size, improved stop band rejection, and symmetrical response.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF circuit, comprising:

a housing structure defining a conductive channel, wherein the channel is characterized by a width dimension which sets a waveguide mode cutoff frequency above the bandpass frequency band of operation of the filter circuit; and a band pass filter circuit disposed in said housing structure for passing RF signals in a frequency pass band and attenuating RF signals outside said pass band, the filter circuit comprising a first input/output (I/O) port, a second I/O port, a plurality of parallel-coupled resonators formed in a planar transmission line medium comprising a dielectric substrate and coupling the first I/O port and the second I/O port, the resonators arranged for signal coupling between alternate resonators in the form of transmission line gaps.

2. The RF circuit of claim 1, wherein the transmission line medium is microstrip or stripline.

3. The RF circuit of claim 1, wherein the filter circuit comprises:

said dielectric substrate having first and second opposed planar surfaces;

a ground plane formed on the first substrate surface; and said resonators formed on the second dielectric surface, the resonators arranged in a staggered arrangement about a linear filter axis with gaps between ends of alternate resonators to provide edge coupling between alternate resonators.

4. The RF circuit of claim 3, wherein said gaps provide symmetrical filter response.

5. The RF Circuit of claim 1, wherein the resonators are arranged in a staggered arrangement about a linear filter axis.

6. The RF circuit of claim 5, wherein the substrate has first and second parallel sides, and said filter axis is generally parallel to said first and second sides.

7. A band pass filter circuit for microwave frequencies, comprising:

a dielectric substrate having first and second opposed planar surfaces;

a ground plane formed on the first substrate surface;

a plurality of parallel-coupled resonators formed on the second dielectric surface, the resonators arranged in a staggered arrangement about a linear filter axis with gaps between ends of alternate resonators to provide edge coupling between alternate resonators and;

a housing structure defining a conducive channel, said substrate disposed in said channel, and wherein the channel is characterized by a width dimension which sets a waveguide mode cutoff frequency above the bandpass frequency band of operation of the filter circuit.

8. The filter circuit of claim 7, wherein said gaps provide symmetrical filter response in an attenuation range of interest.

9. An RF circuit, comprising:

a housing structure, comprising a conductive cover structure, defining a conductive channel; and a band pass filter circuit disposed in said housing structure for passing RF signals in a frequency pass band and attenuating RF signals outside said pass band, the filter circuit comprising a first input/output (I/O) port, a second I/O port, a plurality of parallel-coupled resonators formed in a planar transmission line medium comprising a dielectric substrate and coupling the first I/O port and the second I/O port, the resonators arranged for signal coupling between alternate resonators in the form of transmission line gaps.

10. The RF circuit of claim 9, wherein the filter circuit comprises:

said dielectric substrate having first and second opposed planar surfaces;

a ground plane formed on the first substrate surface;

said resonators formed on the second dielectric surface, the resonators arranged in a staggered arrangement about a linear filter axis with gaps between ends of alternate resonators to provide edge coupling between alternate resonators.

11. The RF circuit of claim 10, wherein said gaps provide symmetrical filter response.

12. The RF circuit of claim 9, wherein the channel is characterized by a width dimension which sets a waveguide mode cutoff frequency above the bandpass frequency band of operation of the filter circuit.

13. The RF circuit of claim 9, wherein the transmission line medium is microstrip or stripline.

14. The RF circuit of claim 9, wherein the resonators are arranged in a staggered arrangement about a linear filter axis.

15. The RF circuit of claim 14, wherein the substrate has first and second parallel sides, and said filter axis is generally parallel to said first and second sides.

* * * * *